US007080898B2

(12) United States Patent
Katayama

(10) Patent No.: US 7,080,898 B2
(45) Date of Patent: Jul. 25, 2006

(54) INK CARTRIDGE AND INK JET RECORDING APPARATUS

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 285 days.

(21) Appl. No.: 10/822,602

(22) Filed: Apr. 12, 2004

(65) Prior Publication Data

US 2004/0207698 A1 Oct. 21, 2004

(30) Foreign Application Priority Data

Apr. 16, 2003 (JP) ..... 2003-111891

(51) Int. Cl.
*B41J 2/175* (2006.01)

(52) U.S. Cl. ..... 347/86; 347/85

(58) Field of Classification Search ..... 347/84, 347/85, 86, 87; 141/2, 18, 25
See application file for complete search history.

(56) References Cited

U.S. PATENT DOCUMENTS

| | | | | |
|---|---|---|---|---|
| 4,719,475 A | | 1/1988 | Kiyohara et al. | |
| 5,132,711 A | * | 7/1992 | Shinada et al. | 347/6 |
| 5,760,806 A | | 6/1998 | Oda et al. | |
| 5,992,975 A | * | 11/1999 | Gasvoda et al. | 347/50 |
| 6,012,795 A | * | 1/2000 | Saito et al. | 347/7 |
| 6,048,055 A | | 4/2000 | Hakkaku | |
| 6,302,531 B1 | | 10/2001 | Usui et al. | |
| 6,315,402 B1 | * | 11/2001 | Kawase | 347/85 |
| 6,394,593 B1 | * | 5/2002 | Komplin et al. | 347/86 |
| 2002/0093556 A1 | | 7/2002 | Ishizawa et al. | |

FOREIGN PATENT DOCUMENTS

| | | |
|---|---|---|
| EP | 0 443 245 A2 | 8/1991 |
| EP | 0 881 080 A1 | 12/1998 |
| EP | 0 903 236 A2 | 3/1999 |
| EP | 0 940 258 A1 | 9/1999 |
| EP | 1 203 666 A1 | 5/2002 |
| JP | A-61-233551 | 10/1986 |
| JP | A-6-286151 | 10/1994 |
| JP | A-7-205443 | 8/1995 |
| JP | A-10-315504 | 12/1998 |
| WO | WO 99/44830 | 9/1999 |

* cited by examiner

*Primary Examiner*—Anh T. N. Vo
(74) *Attorney, Agent, or Firm*—Reed Smith LLP

(57) ABSTRACT

An ink cartridge having an ink storing portion which stores an ink to be supplied to a recording head, and which includes a flexible sheet and an outlet portion through which the ink is supplied to the recording head. A liquid chamber accommodates a liquid which contacts under a level thereof, the flexible sheet of the ink storing portion. A gas supplying portion supplies, as the ink is supplied from the ink storing portion to the recording head and accordingly a volume of the ink storing portion is decreased, a gas to the liquid chamber, so that the gas is accumulated above the liquid accommodated by the liquid chamber. A window is provided to detect an interface between the liquid accommodated by the liquid chamber and the gas accumulated above the liquid.

22 Claims, 3 Drawing Sheets

INK CARTRIDGE AND INK JET RECORDING APPARATUS

BACKGROUND OF THE INVENTION

1. Field of the Invention

The present invention relates to an ink cartridge and an ink jet recording apparatus and particularly to an ink cartridge and an ink jet recording apparatus each of which assures that ink is ejected with stability as an amount of ink remaining in an ink storing portion decreases.

2. Discussion of Related Art

There is known an ink jet recording apparatus in which ink is supplied from an ink cartridge to a recording head and each of a plurality of nozzles of the recording head ejects a droplet of the ink to record an image on a recording medium such as a sheet of paper.

For example, Japanese Patent Publication No. 61-233551 or its corresponding U.S. Pat. No. 4,719,475 discloses an ink cartridge including an ink bag which stores ink, and an ink jet recording apparatus including the ink cartridge. The ink bag is obtained by bonding flexible sheets to each other, and accordingly has a flat configuration. The flat ink bag is accommodated in the ink cartridge, such that the flat bag takes an upright posture in which a widthwise direction of the flat bag is parallel to a vertical direction. In this state, the ink cartridge is connected to the recording head.

As the recording head repeats recording operations, the amount of ink in the ink bag gradually decreases and accordingly the ink bag gradually shrinks and becomes thinner. Therefore, in the case where the ink bag is used in the above-indicated state in which the widthwise direction thereof is parallel to the vertical direction, a height position of a level of the ink in the ink bag moves in a vertically downward direction as the amount of ink decreases and accordingly a shape of the ink bag changes.

When the height position of the ink level of the ink bag changes, a difference between the height position of the ink level and a height position of the recording head or, in other words, a back pressure acting on the ink present in the recording head changes, which leads to lowering a recording quality of the recording head.

If the ink bag is assembled into the ink cartridge, not in the above-indicated upright posture but in a lying-down posture in which the ink bag takes a minimum height, an amount of change of the ink level of the ink bag and accordingly an amount of influence of that change to the back pressure can be reduced as compared with the case where the bag is assembled in its upright posture. However, in a full-color recording apparatus, a plurality of ink cartridges are arranged in an array in a widthwise direction thereof, which leads to increasing an overall size of the recording apparatus. On the other hand, in the case where it is required to reduce the overall size of the recording apparatus, a size of each ink bag (i.e., an amount of ink stored in each ink bag) and/or a position where each ink cartridge is attached are/is limited. In addition, in the case where the ink bag is formed of flexible sheets, those flexible sheets as a whole are not uniformly deformed as the amount of ink decreases. Therefore, if the deformation of the flexible sheets may directly be detected, or if an electrode may be inserted into the ink bag, it is difficult to detect, with accuracy, a remaining amount of the ink under the condition that the remaining amount is small.

SUMMARY OF THE INVENTION

It is therefore an object of the present invention to provide an ink cartridge and an ink jet recording apparatus which are free from at least one of the above-identified problems. This object has been achieved according to the present invention.

According to a first aspect of the present invention, there is provided an ink cartridge, comprising an ink storing portion which stores an ink to be supplied to a recording head, and which includes a flexible sheet and an outlet portion through which the ink is supplied to the recording head; a liquid chamber which accommodates a liquid which contacts, under a level thereof, the flexible sheet of the ink storing portion; a gas supplying portion which supplies, as the ink is supplied from the ink storing portion to the recording head and accordingly a volume of the ink storing portion is decreased, a window to detect an interface between the liquid accommodated by the liquid chamber and the gas accumulated above the liquid.

In the present ink cartridge, the ink is supplied from the ink storing portion thereof to the recording head, and the ink storing portion includes the flexible sheet. Therefore, as the ink is consumed by the recording head, the volume of the ink storing portion changes, i.e., decreases while the shape of the ink storing portion changes. The liquid chamber accommodates the liquid which contacts, under the level thereof, the flexible sheet of the ink storing portion. Thus, as the volume of the ink storing portion decreases, the pressure of the liquid in the liquid chamber decreases. Therefore, an appropriate amount of gas is supplied from the gas supplying portion and the gas is accumulated above the liquid accommodated in the liquid chamber.

The reason why the appropriate amount of gas is supplied from the gas supplying portion into the liquid chamber via the liquid-chamber communication hole, so as to compensate for the decrease of pressure of the liquid, caused by the decrease of volume of the ink storing portion, is that the pressure of the gas in the gas supplying portion acts on the liquid at the liquid-chamber communication hole. Therefore, the pressure of the ink held by the recording head can be kept at a certain value, and accordingly the recording head can perform the recording operations with high quality.

According to a second aspect of the present invention, there is provided an ink jet recording apparatus, comprising an ink cartridge according to the first aspect of the invention; an ink jet recording head which is supplied with the ink from the ink cartridge, and which ejects a droplet of the ink toward a recording medium; and a holding portion which holds the ink cartridge such that the liquid-chamber communication hole of the gas supplying portion is located at a height position which is lower than a height position of an interface between the liquid accommodated by the liquid chamber and the gas accumulated above the liquid.

In the present ink jet recording head, the holding portion holds the ink cartridge such that the liquid-chamber communication hole of the gas supplying portion is located at the height position which is lower than the height position of the interface between the liquid in the liquid chamber and the gas accumulated above the liquid. The ink is supplied from the ink cartridge held by the holding portion, to the ink jet recording head, and is ejected by the recording head toward the recording medium.

Since the holding portion of the ink jet recording head holds the ink cartridge such that the liquid-chamber communication hole is located at the height position lower than the height position of the interface between the liquid in the liquid chamber and the gas accumulated above the liquid, the pressure of the ink ejected by the recording head is stabilized, and accordingly the recording head can perform the recording operations with high quality.

According to a third aspect of the present invention, there is provided an ink jet recording apparatus, comprising an ink cartridge according to the first aspect of the invention; an ink jet recording head which is supplied with the ink from the ink cartridge, and which ejects a droplet of the ink toward a recording medium; and a reference-position detector which detects whether a height position of an interface between the liquid accommodated by the liquid chamber and the gas accumulated above the liquid has reached a reference position corresponding to a predetermined maximum consumption amount of the ink.

In the present ink jet recording head, the ink is supplied from the ink cartridge to the recording head, and is ejected by the recording head toward the recording medium. As the ink is consumed by the recording head, the height position of the interface between the liquid in the liquid chamber and the gas accumulated above the liquid changes, i.e., lowers. The reference-position detector detects whether the height position of the interface has reached the reference position corresponding to the predetermined maximum consumption amount of the ink.

Since the reference-position detector detects whether the height position of the interface has reached the reference position corresponding to the pre-determined maximum consumption amount of the ink, a remaining amount of the ink stored by the ink storing portion can be detected with reliability. In addition, since the change of volume of the ink storing portion can be detected by detecting the change of level of the liquid contacting the flexible sheet of the ink storing portion, the change of volume of the ink can be detected with accuracy, without being adversely affected by a possible non-uniform deformation of the flexible sheet of the ink storing portion.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 3A is a view of the ink cartridge in a state before the ink is consumed; FIG. 3B is a view of the ink cartridge in a state after some ink is consumed; and FIG. 3C is a view of the ink cartridge in a state after more ink is consumed.

DETAILED DESCRIPTION OF THE PREFERRED EMBODIMENTS

Figure 1:
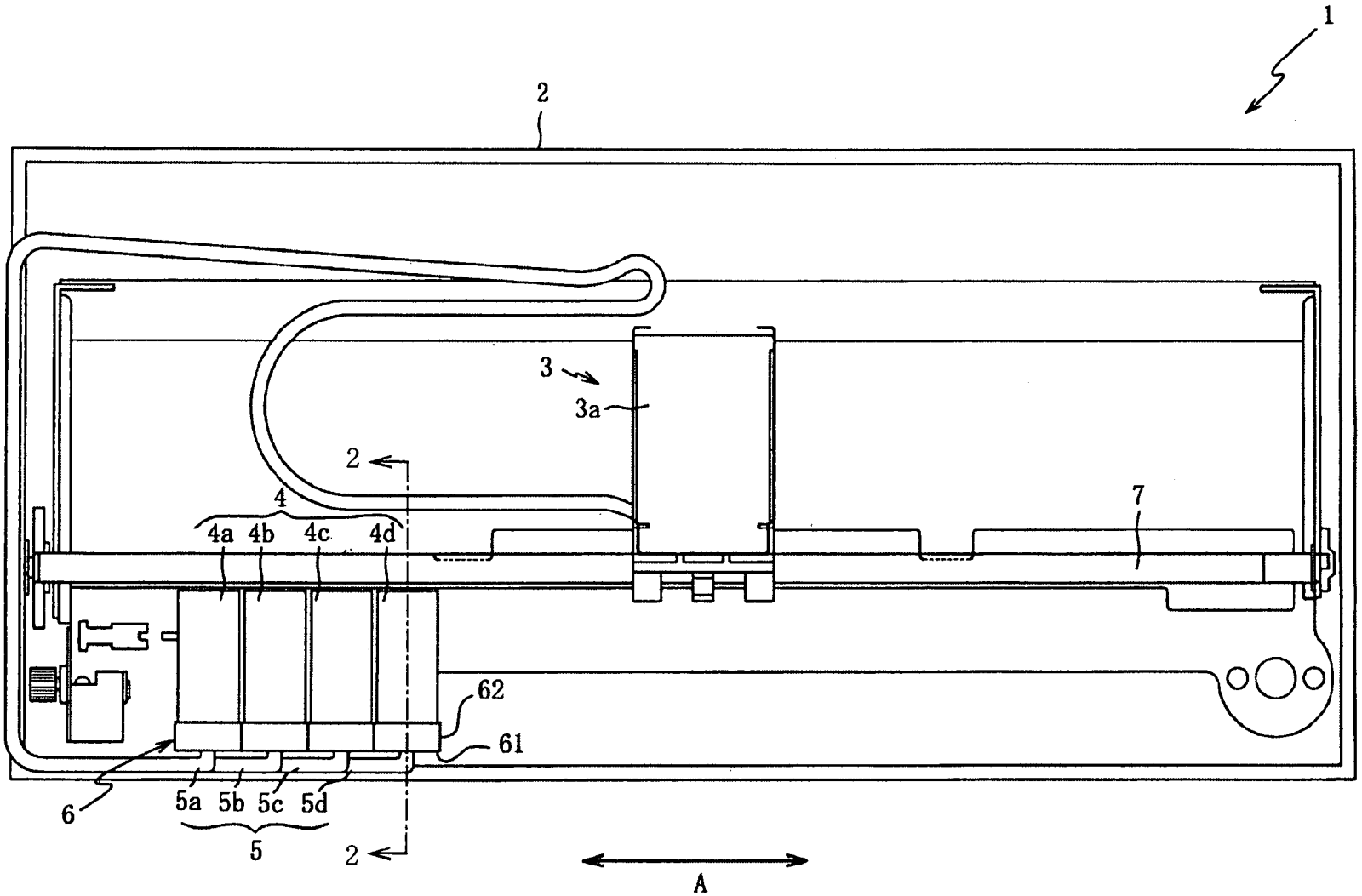
FIG. 1 is a plan view of an ink jet recording apparatus to which the present invention is applied and which includes an ink cartridge to which the present invention is also applied.

Hereinafter, there will be described preferred embodiments of the present invention by reference to the drawings. FIG. 1 shows an ink jet recording apparatus 1 which embodies the present invention and which includes four ink cartridges 4 (4*a*, 4*b*, 4*c*, 4*d*) each of which also embodies the present invention. As shown in FIG. 1, the ink jet recording apparatus 1 includes a housing 2, a recording head unit 3, and the ink cartridges 4. The housing 2 is formed of a fire resistant plastic material and has a generally box-like configuration. The recording head unit 3 is detachably provided in an upper portion of the housing 2. The ink cartridges 4 supply different sorts (i.e., colors) of inks to the recording head unit 3.

The recording head unit 3 includes a plurality of ink jet recording heads which are mounted on a carriage 3*a* and each of which ejects an ink toward a recording medium, such as a sheet of paper, so as to record an image on the recording medium. The carriage 3*a* is slideable on a guide rod 7, and the guide rod 7 supports the carriage 3*a*, such that the carriage 3*a* is movable in directions, indicated at arrows A in FIG. 1, that are perpendicular to a direction in which the recording medium is fed. Those directions A are parallel to a lengthwise direction of the housing 2. When an electric motor, not shown, is rotated, and a belt, not shown, connected to the carriage 3*a* is driven, the carriage 3*a* and the recording head unit 3 mounted thereon are reciprocated on the guide rod 7 in the lengthwise direction of the housing 2.

The ink cartridges 4 which are provided in a lower portion of the housing 2 include four cartridges 4*a*, 4*b*, 4*c*, 4*d* that store black, yellow, cyan, and magenta inks, respectively. The ink cartridges 4*a*, 4*b*, 4*c*, 4*d* communicate with the recording head unit 3 via respective ink tubes 5 (5*a*, 5*b*, 5*c*, 5*d*), so that the inks stored by the ink cartridges 4*a* to 4*d* are supplied to the recording head unit 3 via the ink tubes 5*a* to 5*d*, respectively. The housing 2 includes a holding portion 6 that can hold each of the ink cartridges 4*a* to 4*d* such that the each cartridge 4 held thereby takes its proper, upright posture and is detachable therefrom. Since the four ink cartridges 4*a* to 4*d* have an identical construction, one of the four cartridges 4 will be referred to as the "ink cartridge 4" in the following description.

Figure 2:
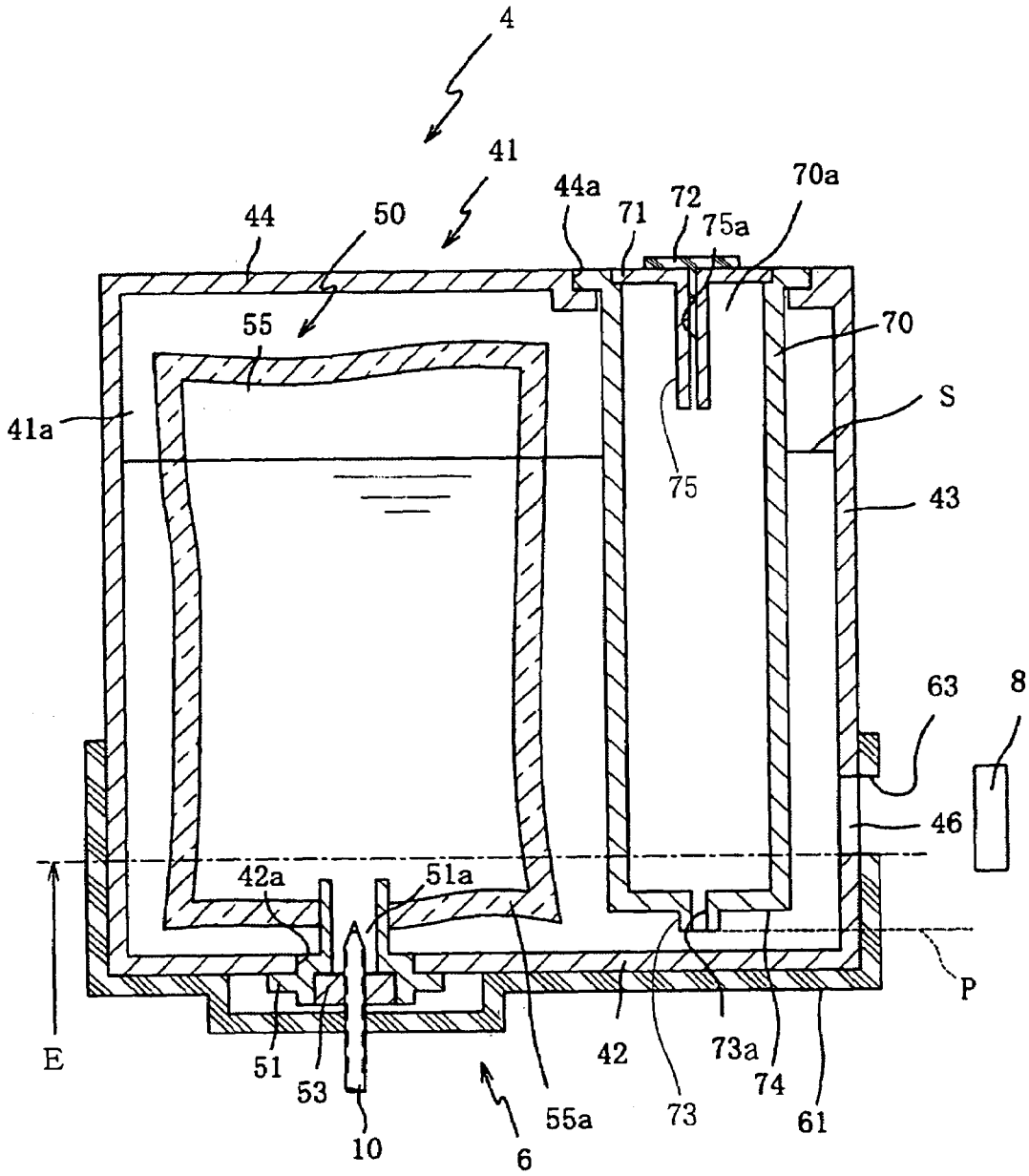
FIG. 2 is a cross-section view, taken along 2—2 in FIG. 1, showing a construction of the ink cartridge.

The holding portion 6 includes a bottom wall 61, and a side wall 62 extending upward from an outer periphery of the bottom wall 61, and has a generally box-like configuration having an upper opening through which the ink cartridge 4 can be inserted. The side wall 62 has, in a rear portion thereof, a window 63 that is formed through a thickness thereof, as shown in FIG. 2. The holding portion 6 is fixed to the housing 2 such that in a state in which the housing 2 is installed, a plane defined by the bottom wall 61 of the holding portion 6 is parallel to a horizontal direction, i.e., is perpendicular to a vertical direction. In addition, a photoelectric sensor 8 is provided at a position in rear of the window 63, such that the photoelectric sensor 8 is opposed to the window 63. Moreover, in the housing 2, there is provided a control device, not shown, in the form of a circuit board that includes a CPU (central processing unit), a ROM (read only memory), and a RAM (random access memory), and controls an operation of the ink jet recording apparatus 1 according to a control program pre-stored in the ROM.

FIG. 2 shows the construction of the ink cartridge 4 in detail. As shown in the figure, the ink cartridge 4 includes an accommodating case 41, and an ink package 50 that is entirely accommodated by the case 41 and provides an ink storing portion having a flexibility. The accommodating case 41 is formed of a resin material having a rigidity, and has a box-like configuration including a bottom wall 42, a side wall 43 extending upward from an outer periphery of the bottom wall 42, and a top wall 44 closing an upper end of the side wall 43. The case 41 is obtained by gas-tightly bonding two or more members to each other. The top wall 44 of the case 41 has a through-hole 44*a* which is formed through a thickness of the wall 44 and in which a tubular member 70 is fitted.

The tubular member 70 opens at an upper end thereof corresponding to the top wall 44 of the case 41, and vertically extends, in the case 41, to a lower end thereof located in the vicinity of the bottom wall 42 of the case 41. The tubular member 70 has a gas supplying chamber 70*a* as a gas supplying portion, and the case 41 has a liquid chamber 41*a* defined by inner surfaces thereof and outer surfaces of the tubular member 70.

In the case 41, the gas supplying chamber 70*a* stores air as a gas that is to be supplied into the liquid chamber 41*a*. The upper opening of the tubular member 70 is closed by a lid member 75, and the gas supplying chamber 70*a* communicates with the atmosphere via an atmosphere communication hole 75*a* that is formed through a tubular portion 75 extending downward from the lid member 71. When the ink cartridge 4 is not in use, the communication hole 75*a* is closed by a sealing plug 72; and when the cartridge 4 is in use, that is, supplies the ink to the recording head unit 3, the sealing plug 72 is removed.

A bottom wall 74 of the tubular member 70 has a liquid-chamber communication hole 73*a* that is formed through a tubular portion 73 extending downward therefrom toward the bottom wall 42 of the case 41. The communication hole 73*a* communicates the gas supplying chamber 70*a* and the liquid chamber 41*a* with each other. A transverse cross section of the communication hole 73*a* is smaller than a transverse cross section of a main portion of the tubular member 70. Preferably, the communication hole 73*a* has a diameter of from 0.5 mm to 2.0 mm, most preferably, 1.0 mm.

The liquid chamber 41*a* accommodates an entirety of the ink package 50.

The ink package 50 includes a bag portion 55 that liquid-tightly stores the ink, and a spout 51 that communicates the bag portion 55 and the corresponding ink tube 5 (FIG. 3A) with each other.

The bag portion 55 is obtained by first placing two flexible sheets such that the two sheets are opposed to each other in a direction perpendicular to a sheet bearing FIG. 2, and subsequently bonding, by welding, respective U-shaped peripheries of the two sheets to each other while leaving an opening portion 55*a* open. The thus obtained bag portion 55 is filled with a degassed ink. After the bag portion 55 is filled with the degassed ink, the opening portion 55*a* is also welded with the spout 51 being inserted therein.

Each of the flexible sheets used to form the bag portion 55 has a laminate structure including an intermediate, aluminum alloy layer; an adhesive layer and a nylon layer (i.e., outer layers) stacked in the order of description on one surface of the intermediate layer: and an adhesive layer, a polyethylene terephthalate layer, an adhesive layer, and a polypropylene layer (i.e., inner layers) stacked in the order of description on the other surface of the intermediate layer. Since each of the flexible sheets has the laminate structure, the bag portion 55 enjoys a high degree of durability. In particular, since each flexible sheet includes the polypropylene layer as one of the inner layers thereof, the bag portion 55 enjoys a high degree of resistance to ink. Moreover, the aluminum alloy layer as the intermediate layer of each flexible sheet effectively prevents an external gas from permeating the bag portion 55 and thereby deteriorating the degree of degassing of the ink.

The spout 51 has an outlet 51*a* through which the ink flows from the bag portion 55 to outside the ink package 50 (or the ink cartridge 4), and an elastic plug 53 is press-fitted in the outlet 51*a*, so that the elastic plug 53 separates the bag portion 55 and the ink tube 5 from each other.

The spout 51 is formed of a material containing, as a main component thereof, polypropylene that has a high degree of resistance to ink.

The spout 51 includes an end portion that projects outward from the bag portion 55 and is liquid-tightly fitted in a hole 42*a*, formed through a thickness of the bottom wall 42 of the case 41, so that the spout 51 is fixed to the case 41. Thus, the ink package 50 is accommodated, and fixed, in the ink cartridge 4, in a state in which the package 50 takes an upright posture.

The liquid chamber 41*a* accommodates water as a sort of liquid, and the ink package 50 is immersed in the water. The case 41 has an inlet, not shown, through which the water is poured into the liquid chamber 41*a*, and the inlet is closed after the pouring of water is finished. The liquid chamber 41*a* is gas-tightly sealed except for the communication hole 73*a*, and accordingly the atmospheric pressure does not act on a top portion of the liquid chamber 41*a*. Thus, no water flows from the liquid chamber 41*a* into the gas supplying chamber 70*a*. The water contacts the atmospheric air at a lower end of the communication hole 73*a*. That is, the atmospheric pressure acts on the water at the lower end of the hole 73*a*, i.e., a height position, P, indicated at broken line in FIG. 2.

As the ink is consumed, the ink package 50 shrinks, i.e., becomes thinner in the direction perpendicular to the sheet bearing FIG. 2, and accordingly the pressure of the water in the liquid chamber 41*a* decreases. Thus, an appropriate amount of air that compensates for the amount of decrease of the water pressure flows from the gas supplying chamber 70*a* into the liquid chamber 41*a* via the communication hole 73*a*. Since the case 41 has a sufficiently higher degree of rigidity than that of the bag portion 55 of the ink package 50, the case 41 is not deformed by the decreasing of pressure of the water in the liquid chamber 41*a*. Thus, an interface, S, is produced between the water and the air accumulated in the top portion of the liquid chamber 41*a*. As the amount of ink present in the ink package 50 decreases, the interface S lowers with an upper surface, i.e., a level of the ink. The height position P where the communication hole 73*a* is located is pre-set to be lower than a height position of the interface S when the amount of ink in the package 50 reaches an end (i.e., empty) position E corresponding to a predetermined maximum consumption amount of the ink. The photoelectric sensor 8 is for detecting and judging whether the interface S, i.e., the amount of ink in the package 50 has reached the empty position E. The side wall 43 of the case 41 has a transparent window 46 whose lower end is level with the empty position E. The photoelectric sensor 8 includes a light emitter and a light receiver, well known in the art, and the above-indicated control device judges whether the interface S is higher, or lower, than the lower end of the window 46, based on an output signal supplied from the sensor 8, more specifically described, based on a difference between respective light intensities detected by the light receiver from the water and the atmospheric air. However, the height position of the interface S may be detected by an ink-amount detecting device or a liquid-surface detecting device each of which is known in the art.

The bottom wall 61 of the holding portion 6 supports a hollow needle 10 as a sort of ink supplying member. When the ink cartridge 4 is inserted in, and held by, the holding portion 6, the hollow needle 10 penetrates the elastic plug 53 and communicates with the outlet 51*a* of the ink package 50. In this state, the ink package 50 takes its proper upright posture in which a widthwise direction of the package 50 is parallel to a vertical direction, and the communication hole 73*a* is located at the lower end of the gas supplying chamber 70*a*. The hollow needle 10 supplies the ink to the recording head unit 3 via the corresponding ink tube 5. The recording head unit 3 has, in a lower surface thereof, a plurality of ink ejection nozzles, not shown, at a height position that is higher by a difference, T4, than the height position P of the lower end of the communication hole 73*a* where the atmospheric pressure acts on the water in the liquid chamber 41*a*. Therefore, a back pressure corresponding to the height difference T4 (FIG. 3A) acts on the ink held by the recording head unit 3.

Figure 3A:
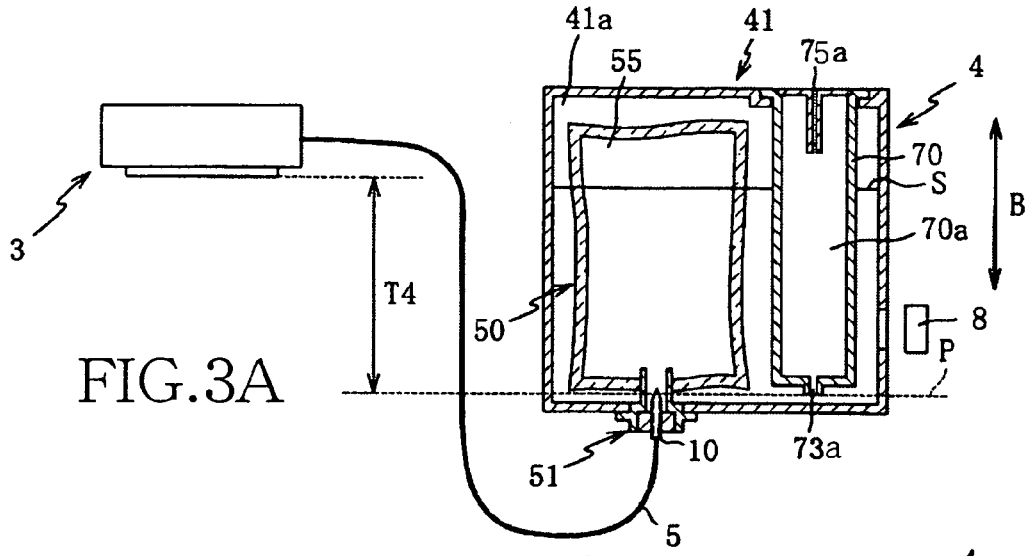
FIGS. 3A, 3B, and 3C are illustrative views for explaining changes of volume of an ink package of the ink cartridge when ink is consumed: more specifically described.
Figure 3B:
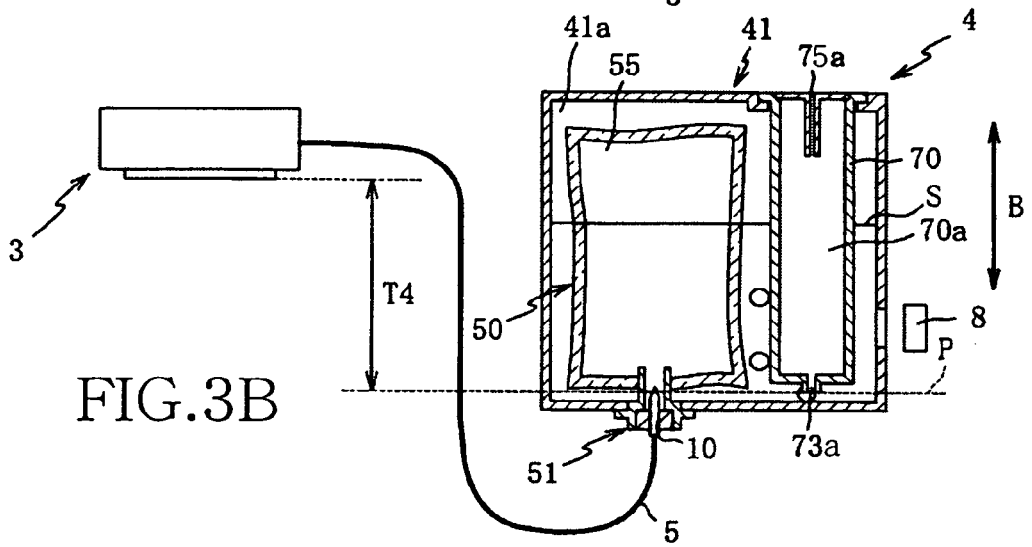
Figure 3C:
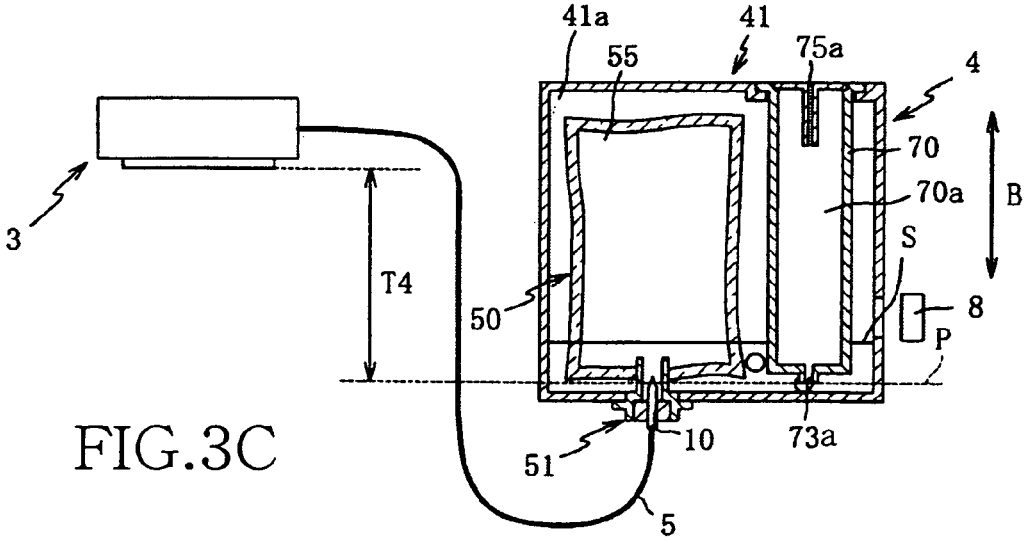

As the ink is repeatedly ejected from the recording head unit 3 and accordingly the ink in the ink package 50 is consumed, the bag portion 55 shrinks in the direction perpendicular to the sheet bearing FIG. 2. Consequently the pressure of the water in the liquid chamber 41*a* decreases by an amount corresponding to the amount of decrease of the volume of the bag portion 55, and an amount of air that compensates for the amount of decrease of the water pressure flows in the form of bubbles, as shown in FIGS. 3B and 3C, from the gas supplying chamber 70*a* into the liquid chamber 41*a* via the communication hole 73*a*. Thus, the interface S between the air and the water in the liquid chamber 41*a* lowers as shown in the figures. However, the height difference T4 between the position P of the lower end of the communication hole 73*a* where the atmospheric pressure acts on the water, and the lower surface of the recording head unit 3. In FIGS. 3A, 3B, and 3C, vertical directions are indicated at arrows B.

As the ink in the ink package 50 is consumed, a height position of the level of the ink in the same 50 changes. However, the back pressure acting on the ink in the recording head unit 3 is kept constant, and accordingly the head unit 3 can eject the ink with a high degree of stability and enjoy a high degree of recording quality.

As the ink is consumed, the flexible sheets constituting the bag portion 55 of the ink package 50 are deformed in a non-uniform manner, as well known in the art. However, in the present embodiment, the current amount of volume of the bag portion 55 can be accurately represented by the current height position of the interface S between the water and the air, the fact that the amount of ink in the bag portion 55 has reached the pre-set end (i.e., empty) position E is accurately detected by the photoelectric sensor 8.

When the ink cartridge 4 is shipped from the manufacturing factory, the ink bag 50 is immersed in the water. Therefore, the water prevents external gases from entering the ink via the flexible sheets constituting the bag portion 55 of the ink bag 50, and additionally prevents moisture in the ink from vaporizing from the ink. Thus, respective initial degrees of degassing and viscosity of the ink can be maintained for a long time. In particular, in the case where the bag portion 55 is formed of a flexible sheet that includes, in its laminate structure, not only a metallic layer but also an inner resin layer, the resin layer is exposed at end surfaces of the flexible sheet and accordingly allows external gases to enter the ink in the bag portion 55, and moisture to vaporize from the ink. However, since the bag portion 55 is immersed in the water as described above, those problems can be avoided. The water may be replaced with other sorts of liquids, such as a sol or a solvent. Preferably, a sol having a viscosity of from 1 to 7 cps is used. In particular, in the case where the water is replaced with a solvent as one of components of the ink in the bag portion 55, the change of composition of the ink can be minimized even if the solvent permeates from the liquid chamber 41*a* into the bag portion 55.

While the present invention has been described in its preferred embodiment, it is to be understood that the present invention may be otherwise embodied.

For example, in the illustrated embodiment, the bag portion 55 as the ink storing portion is formed using the two flexible sheets. However, the bag portion 55 may be provided by a rigid container which, however, includes one wall formed of a flexible sheet.

In the illustrated embodiment, the liquid-chamber communication hole 73*a* of the gas supplying chamber 70*a* as the gas supplying portion is located at the height position P which is lower than the height position of the interface S between the liquid accommodated by the liquid chamber 41*a* and the gas accumulated above the liquid. According to this feature, the decrease of amount of the ink stored by the bag portion 55 of the ink package 50 as the ink storing portion does not change the pressure acting on the ink present in the recording head. Thus, the pressure of the ink ejected by the recording head can be stabilized and accordingly the recording head can exhibit the excellent recording performance.

In the illustrated embodiment, the liquid-chamber communication hole 73*a* of the gas supplying chamber 70*a* is located at the height position P which is lower than the height position of the interface S when the predetermined maximum consumption amount of the ink is supplied from the bag portion 55 of the ink package 50 as the ink storing portion to the recording head unit 3 as the recording head. According to this feature, the liquid-chamber communication hole 73*a* of the gas supplying chamber 70*a* is located at the height position P lower than the height position of the interface S even when the amount of the ink supplied from the bag portion 55 to the recording head unit 3 has reached the pre-determined maximum consumption amount. Therefore, the pressure of the ink ejected by the recording head unit 3 can be kept stable till the amount of the ink supplied from the bag portion 55 reaches the pre-determined maximum consumption amount, i.e., the bag portion 55 is substantially emptied. Thus, the recording head unit 3 can exhibit the excellent recording performance.

In the illustrated embodiment, the ink cartridge further comprises the accommodating case 41 which defines, therein, the liquid chamber 41*a*, and the case 41 maintains its shape when the volume of the bag portion 55 of the ink package 50 as the ink storing portion is decreased by supplying of the ink from the bag portion 55 to the recording head unit 3 while the flexible sheet of the ink storing portion 55 is deformed. According to this feature, as the volume of the bag portion 55 is decreased by the supply of the ink from the bag portion 55, the case 41 defining the liquid chamber 41*a* maintains its shape. Therefore, the pressure of the ink ejected by the recording head unit 3 is further stabilized and the recording head unit 3 can exhibit the more excellent recording performance.

In the illustrated embodiment, the liquid comprises the water. According to this feature, the liquid can be easily dealt with in the process of producing the ink cartridge 4, and can be less influential to the environment than organic solvents. Thus, the ink cartridge 4 can be produced at the lower cost.

In the illustrated embodiment, the gas supplying chamber 70*a* as the air supplying portion includes the atmosphere communication hole 75*a* which communicates with the atmosphere. According to this feature, air (i.e., ambient air) can be supplied to the liquid chamber 41*a* with not a complex or sophisticated structure but a simple structure in which the gas supplying chamber 70*a* communicates with the atmosphere via the atmosphere communication hole 75*a*. Thus, the atmospheric pressure continues acting on the liquid at the liquid-chamber communication hole 73*a*.

In the illustrated embodiment, the ink cartridge 4 includes the tubular member 70 which defines, therein, the gas supplying chamber 70*a* as the gas supplying portion and which is immersed in the liquid accommodated by the liquid chamber 41*a*, and a transverse cross section of the liquid-chamber communication hole 73*a* is smaller than that of the gas supplying chamber 70*a*. According to this feature, the air as the gas is supplied in the form of small bubbles from the gas supplying chamber 70*a* into the liquid chamber 41*a*. Consequently the amount of change of the pressure of the ink can be reduced and accordingly the recording head unit 3 can be prevented from the pulsations of pressure of the ink.

In the illustrated embodiment, the ink jet recording apparatus 1 further comprises the photoelectric sensor 8 as the reference-position detector which detects whether the height position of the interface S in the ink cartridge 4 has reached the reference position E corresponding to the predetermined maximum consumption amount of the ink. According to this feature, the height position of the interface S corresponding to the amount of the ink stored by the bag portion 55 of the ink package 50 as the ink storing portion can be detected with accuracy. In addition, since the change of amount of the ink stored in the bag portion 55 can be detected by detecting the change of level of the liquid contacting the bag portion 55, the change of amount of the ink can be detected with accuracy, without being adversely affected by possible non-uniform deformation of the flexible sheet of the bag portion 55.

It is to be understood that the present invention may be embodied with other changes and improvements that may occur to a person skilled in the art, without departing from the spirit and scope of the invention defined in the appended claims.

What is claimed is:

1. An ink cartridge, comprising:

an ink storing portion which stores an ink to be supplied to a recording head and which includes a flexible sheet and an outlet portion through which the ink is supplied to the recording head, a liquid chamber which accommodates a liquid which contacts, under a level thereof, the flexible sheet of the ink storing portion;

a gas supplying portion which supplies, as the ink is supplied from the ink storing portion to the recording head and accordingly a volume of the ink storing portion is decreased, a gas to the liquid chamber, so that the gas is accumulated above the liquid accommodated by the liquid chamber; and a window to detect an interface between the liquid accommodated by the liquid chamber and the gas accumulated above the liquid.

2. The ink cartridge according to claim 1, further comprising a case which defines, therein, the liquid chamber, wherein the case maintains a shape thereof when the volume of the ink storing portion is decreased by supplying of the ink from the ink storing portion to the recording head while the flexible sheet of the ink storing portion is deformed.

3. The ink cartridge according to claim 1, wherein the liquid comprises a water.

4. The ink cartridge according to claim 1, wherein the gas supplying portion includes an atmosphere communication hole which communicates with an atmosphere.

5. The ink cartridge according to claim 1, wherein the liquid chamber accommodates, in addition to the liquid, an entirety of the ink storing portion.

6. The ink cartridge according to claim 1, further comprising a case which defines, therein, the liquid chamber, wherein the case has, in a side wall thereof, the window.

7. The ink cartridge according to claim 1, wherein the window is transparent.

8. The ink cartridge according to claim 1, wherein the window is for detecting whether a height position of the interface in the ink cartridge has reached a reference position corresponding to a predetermined maximum consumption amount of the ink.

9. The ink cartridge according to claim 8, wherein a lower end of the window is level with the reference position.

10. The ink cartridge according to claim 1, wherein the window is for detecting the interface that lowers as the volume of the ink storing portion decreases, and corresponds to a remaining amount of the ink stored by the ink storing portion.

11. The ink cartridge according to claim 1, further comprising a gas storing portion which communicates with the gas supplying portion and stores the gas to be supplied to the liquid chamber, wherein the gas storing portion has a liquid-chamber communication hole which communicates with the liquid chamber and is open in the liquid accommodated by the liquid chamber.

12. The ink cartridge according to claim 11, wherein the liquid-chamber communication hole of the gas storing portion is located at a height position which is lower than a height position of the interface between the liquid accommodated by the liquid chamber and the gas accumulated above the liquid.

13. The ink cartridge according to claim 12, wherein the liquid-chamber communication hole of the gas storing portion is located at the height position which is lower than the height position of the interface when a predetermined maximum amount of the ink has been supplied from the ink storing portion to the recording head.

14. The ink cartridge according to claim 11, wherein the liquid-chamber communication hole communicates with the liquid, at a height position which is substantially level with the outlet portion of the ink storing portion.

15. The ink cartridge according to claim 11, further comprising a tubular member which defines, therein, the gas storing portion and which is immersed in the liquid accommodated by the liquid chamber, wherein a first transverse cross section of the liquid-chamber communication hole is smaller than a second transverse cross section of the gas storing portion.

16. The ink cartridge according to claim 15, wherein the tubular member includes a first tubular portion defining, therein, the liquid-chamber communication hole having the first transverse cross section, and a second tubular portion defining, therein, the gas storing portion having the second transverse cross section.

17. The ink cartridge according to claim 11, wherein the gas supplying portion includes an atmosphere communication hole which communicates with an atmosphere, wherein the ink cartridge further comprises a tubular member which defines, therein, the gas storing portion and which is immersed in the liquid accommodated by the liquid chamber, and wherein the tubular member includes a tubular portion which projects from a top wall thereof into the gas storing portion and which defines, therein, the atmosphere communication hole which communicates the atmosphere and the gas storing portion with each other.

18. An ink jet recording apparatus, comprising:

an ink cartridge including:

an ink storing portion which stores an ink to be supplied to a recording head, and which includes a flexible sheet, and an outlet portion through which the ink is supplied to the recording head, a liquid chamber which accommodates a liquid which contacts, under a level thereof, the flexible sheet of the ink storing portion, a gas supplying portion which supplies, as the ink is supplied from the ink storing portion to the recording head and accordingly a volume of the ink storing portion is decreased, a gas to the liquid chamber, so that the gas is accumulated above the liquid accommodated by the liquid chamber, a window to detect an interface between the liquid accommodated by the liquid chamber and the gas accumulated above the liquid;

an ink jet recording head which is supplied with the ink from the ink cartridge, and which ejects a droplet of the ink toward a recording medium; and a reference-position detector which detects, through the window of the ink cartridge, whether a height position of the interface in the ink cartridge has reached a reference position corresponding to a predetermined maximum consumption amount of the ink.

19. The ink jet recording apparatus according to claim 18, wherein the ink cartridge further comprises a gas storing portion which communicates with the gas supplying portion and stores the gas to be supplied to the liquid chamber, wherein the gas storing portion has a liquid-chamber communication hole which communicates with the liquid chamber and is open in the liquid accommodated by the liquid chamber, and wherein a lower end of the liquid-chamber communication hold of the gas storing portion is located at a height position which is lower than the reference position.

20. The ink jet recording apparatus according to claim 18, wherein the ink cartridge further comprises a gas storing portion which communicates with the gas supplying portion and stores the gas to be supplied to the liquid chamber, wherein the gas storing portion has a liquid-chamber communication hole which communicates with the liquid chamber and is open in the liquid accommodated by the liquid chamber, and wherein the apparatus further comprises a holding portion which holds the ink cartridge such that the liquid-chamber communication hole of the gas storing portion is located at a height position which is lower than the height position of the interface between the liquid accommodated by the liquid chamber and the gas accumulated above the liquid.

21. The ink jet recording apparatus according to claim 20, wherein the holding portion holds the ink cartridge such that a lower end of the liquid-chamber communication hold of the gas storing portion is located at a height position which is lower than a height position of an ink-ejecting surface of the ink jet recording head.

22. The ink jet recording apparatus according to claim 18, wherein the reference-position detector includes a photoelectric sensor.

* * * * *